US005232204A

United States Patent [19]

Nunez

[11] Patent Number: 5,232,204

[45] Date of Patent: Aug. 3, 1993

[54] HEAVY DUTY HOUSE JOIST SUPPORT KIT

[76] Inventor: Norman Nunez, 2928 E. 101 St., Chicago, Ill. 60617

[21] Appl. No.: 969,469

[22] Filed: Oct. 30, 1992

[51] Int. Cl.[5] ..... B66F 3/00

[52] U.S. Cl. ..... 254/133 A

[58] Field of Search ..... 248/354.1, 357; 254/133 A, 133, 134, 98, 100

[56] References Cited

U.S. PATENT DOCUMENTS

| | | | |
|---|---|---|---|
| 1,231,462 | 6/1917 | Tutwiler | 254/133 A |
| 1,681,192 | 8/1928 | McBride | 248/354.1 |
| 2,777,660 | 1/1957 | Albrecht | 254/133 A |
| 3,222,030 | 12/1965 | Thorpe . | |
| 3,655,161 | 4/1972 | Schueler . | |
| 5,177,850 | 1/1993 | Hull et al. | 29/254 |

*Primary Examiner*—Robert C. Watson
*Attorney, Agent, or Firm*—McHale & Slavin

[57] ABSTRACT

The disclosed invention is a portable, temporary support structure (10) in the form of a kit for support of an overhead building joist. The kit is based upon an elongated base support member (12) formed from a hollow pipe which is welded to a base plate (14) at one end with a square threaded sleeve nut (18) coupled to the remaining free end. A one piece engagement jack screw (24) is disposed within the sleeve nut (18) having correlating square threads. In the middle of the engagement jack screw (24) is provided a location for insertion of jack handle (40) allowing the operator to rotate the jack screw (24) while standing in an upright position. A top portion of the engagement jack screw creates an alignment neck for placing a symmetrical upper support member (30) having an elongated length. A self-aligning channel (34) is provided for placement on the free end of the upper support member (30) for contacting the joist to be supported. By rotation of the engagement jack screw (24), the upper support member (30) and associated channel (34) are telescoped upward to provide as self-aligned jack capable of providing from 10 to almost 30 tons of lifting capacity depending upon the jack screw diameter. The kit is easily assembled and disassembled and includes handles (22) and (32) for ease of transportation.

10 Claims, 2 Drawing Sheets

HEAVY DUTY HOUSE JOIST SUPPORT KIT

BACKGROUND OF THE INVENTION

1. Field of the Invention

This invention relates generally to support structures, and more particularly, to an improved house jack in form of a kit for the temporary support of building joists.

2. Description of the Prior Art

There are a variety of devices presently known in the art used for temporary support of building joists. The most commonly employed support is the house jack. A conventional house jack is an inverted cone shaped device having an enlarged footprint leading to a narrow neck. The neck is threaded for acceptance of a jack screw that can be telescoped upwardly. Operation of the house jack requires placing the jack on beneath a building joist. An extension device, typically a 4×4 timber, is then placed on top of the jack screw to span the distance between the jack and the joist to be lifted. Typically a number of joists are lifted simultaneously by placing a second beam across the top of the timber. The adjustability of the jack is then used to raise the timber which in turn raises the beam and finally the joists.

A problem with the conventional house jack is that it can be dangerous to operate. For instance, the use of a 4×4 timber to exert ten tons of force requires the wood to be in perfect condition. In reality all wood has minute cracks, warpage, or the like latent conditions that may propagate into a catastrophic failure under stress. To complicate the matter, unless the beam and jack combination is perfectly aligned, an off center loading can cause both the timber and jack to unexpectedly hurtle across the floor. To help prevent such misalignment the operator needs to use a liquid level or plumb for alignment, either process is difficult due to the weight of the extension timber and practically impossible if the operator is without the assistance of fellow workers.

Another problem with conventional house jacks is that they are typically made cast iron or filled with concrete or the like for stability. The weight of the jack makes it difficult to transport and place into position.

Yet another problem arises if the operator of the house jack relies upon a 2×4 timber to provide extension support. The 2×4 is more readily available at a job site than the 4×4 yet has obvious weaknesses. More commonplace is the use of two 2×4's nailed together to make a 4×4, the use of a double board providing little more than a false sense of security. Since more than one joist is required to be lifted, the beam placed across the top of the extension timber further complicates the aforementioned operation. All the problems with the extension timber apply to the cross support beam.

Yet still another problem with the conventional house jacks is the jack operating location. Typically the house jack is less than two feet in height requiring jack adjustment to be made within the two foot span. This position forces the operator into an unnatural stance requiring the operator to use lower back muscles or otherwise place a strain on the body for jack operation. Since the operator will have a natural reaction to stand upright, an imbalance to the timber can occur when the operator attempts to operate the jack from an upright position, i.e., operating the jack by foot.

U.S. Pat. No. 3,222,030 issued to Thorpe discloses a permanent floor structure support utilizing two co-planar plates having a threaded engagement adjustment mechanism. The Thorpe device cannot span a building joist with the use of an additional extension. If the adjustment mechanism is made solid, the device would be to top heavy thus requiring the support base to remain hollow. If the support base is enlarged, adjustment must be made at the top of the structure causing the operator to make operate over his head. Any attempt to exert pressure while working over the operators head can result in injury as previously mentioned.

Another structural support device is disclosed in U.S. Pat. No. 3,655,161, issued to Schueler. The Schueler device is a post shore having a means for rough adjustment as well as fine adjustment. The device is complicated and made for permanent installation. Disadvantages of adjustment is duplicated in the Schueler device requiring adjustment at the bottom as well as the top of the structure making both positions difficult to adjust. Schueler illustrates the need for a stable base by disclosing the use of anchor bolts fastened through the bottom plate.

Therefore, there exists a need for a support structure kit capable of installation without the need for additional shoring such as timbers; a structure that is self aligning; adjustable at a location that is safe for the operator; reduces the opportunity for injury; and dissembles for ease of portability and storage.

SUMMARY OF THE INVENTION

The instant invention provides an improved support structure in the form of a house jack kit. The house jack is a portable, temporary support structure placed in the form of a kit for support of overhead building joists as found in the typical home. The kit is based upon a 30 inch high base support member formed from a hollow pipe which is welded to a base plate at one end. A square threaded sleeve nut is coupled, preferably by welding, to the remaining free end. The sleeve is used in combination with a one piece engagement jack screw having correlating square threads for engagement with the sleeve nut. In the middle of the engagement jack screw is a jack handle insertion section is provided allowing the operator to rotate the jack screw at a near upright or standing position. A top portion of the engagement jack screw creates an alignment neck wherein a symmetrical, hollow, upper support member having a length of about 48 inches is placed. It should be noted that the length of the upper support member can be sized for a particular ceiling height and variations are deemed a part of this invention. The 48 inch length is sized for the conventional 7 foot basement ceiling. A self-aligning channel is provided for placement on the free end of the upper support member for contacting the joist, or more typically, for contacting a cross support beam for the lifting and support of a plurality of joists. By rotation of the engagement jack screw, the upper support member and associated channel is telescoped upward providing, dependant upon the size of the kit, from 10 to almost 30 tons of lifting capacity. The kit is easily assembled and disassembled and includes handles for ease of transportation.

In accordance with the instant invention, it is an object thereof to provide a house jack kit that eliminates the need for separate shoring products such as wood, timber, or the like.

It is an additional object of the instant invention to provide an improved house jack that does not require alignment by liquid level and includes the use of structural members to safely accommodate minor misalignment.

It is still another object of the instant invention to provide a portable, jack which includes handles for ease of carrying and storage.

It is yet still another object of the instant invention to provide a centrally located position for operation of the house jack allowing the operator to work in an upright position thereby allowing optimum force generation by use of the operators legs and eliminating the chance of straining the operators back.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the instant invention and illustrate various objects and features thereof.

DETAILED DESCRIPTION OF THE PREFERRED EMBODIMENT

As required, detailed embodiments of the instant invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the instant invention in virtually any appropriately detailed structure.

Figure 1:
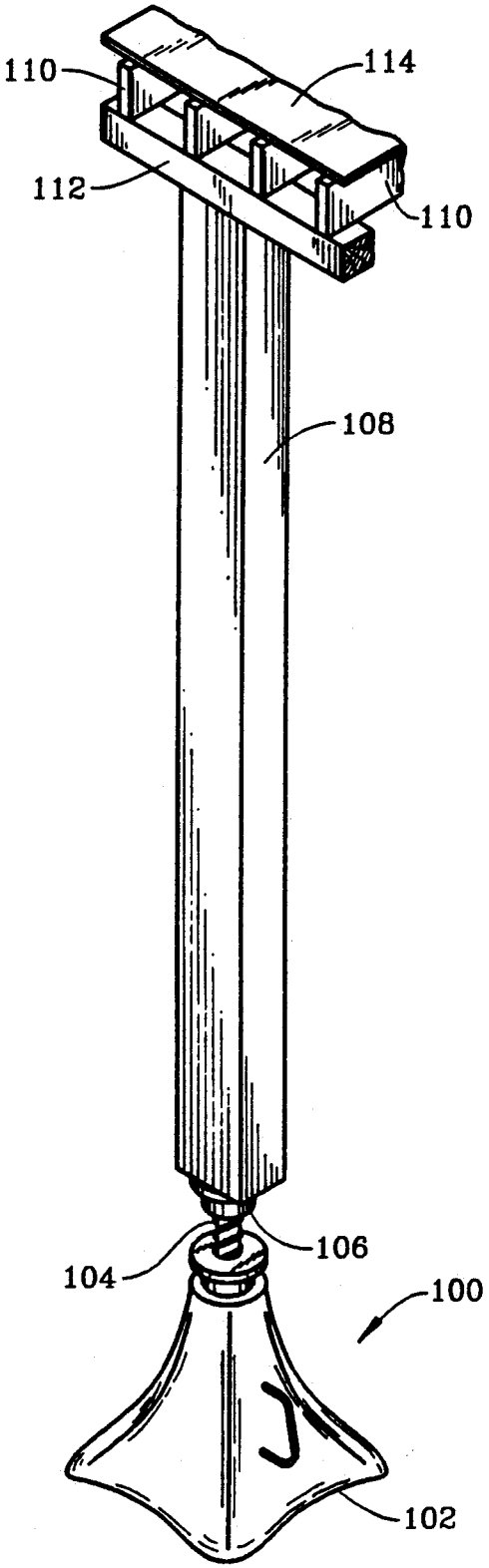
FIG. 1 is a side plan view of the prior art.

FIG. 1 illustrates the conventional prior art house jack 100 having a structural support base 102 and threaded engagement screw 104. Placed on top of an engagement screw platform 106 is a 4×4 wood timber 108 or the like vertically placed beam. Preferably the beam 108 is perfectly aligned in a vertical position with the joists 110 to be supported to prevent lifting in an angular or off center manner. In operation, maintaining the alignment requires the operator to align the vertical beam 108 while operating the jack. For stability the support base 102 is made of cast iron or filled with concrete to prevent sliding during the initial aligning of the vertical beam 108. Typically a long 4×4 or 4×6 temporary horizontal beam 112 is balanced on top of the vertical beam 108 for purposes of multiple joist 110 support for raising or support of floor section 114. The usage of the horizontal beam 112 requires the operator to balance the horizontal beam 112 on top of vertical beam 108 while positioning base 102 for alignment, further engaging screw 104 to lift the supports into position. Screw engagement is provided at the beam support 106, typically at a height of less than 24 inches from the floor.

Figure 2:
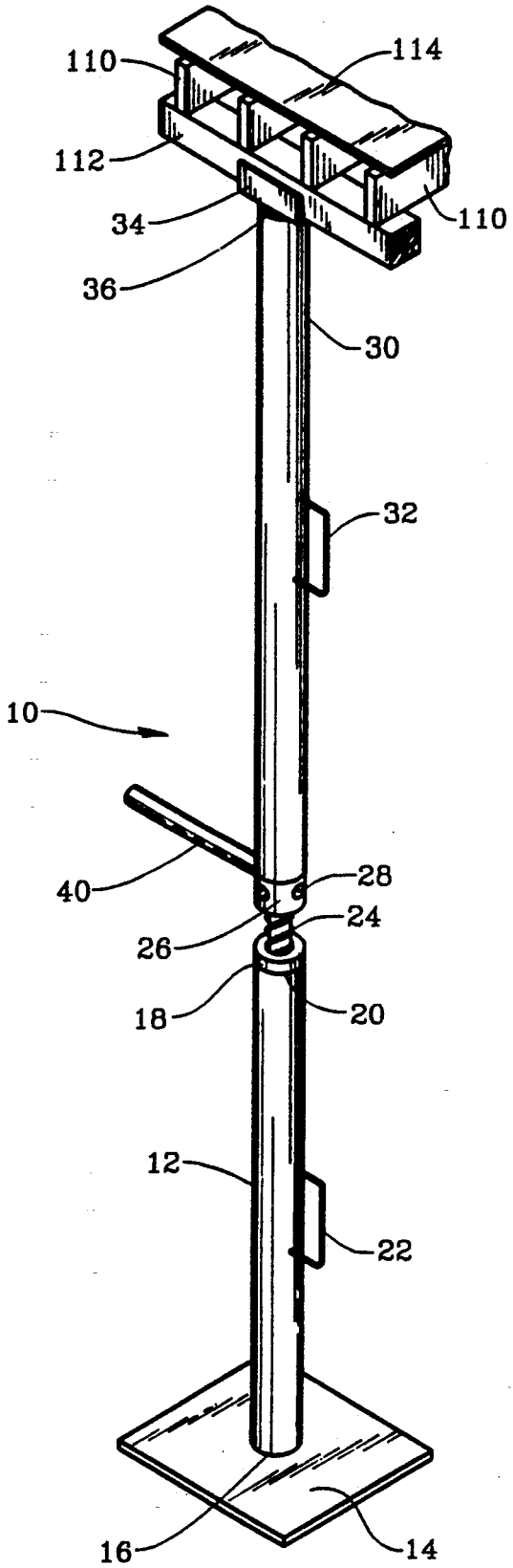
PRIOR ART FIG. 2
FIG. 2 is a side plan view of the instant invention.

Now referring to FIG. 2, depicted is a preferred embodiment of the improved house jack, generally characterized by the reference numeral 10, comprises a base structural member 12 constructed of heavy gauge sidewall pipe. At the bottom of member 12 is planar base plate 14 welded 16 perpendicular to the structural member 12 allowing self alignment of the structure in relation to the flooring. At the top of member 12 is a means for accepting a threaded screw used for adjustment, the preferred means being a sleeve nut 18 welded along joint 20 to member 12. The sleeve nut 18 should provide at least two inches of threaded engagement. For optimum force transfer, a 2 inch diameter by 2 square threads per inch screw thread engagement is recommended.

Due to the weight difference between support plate 14 and sleeve nut 18, handle 22 is located at a predetermined position along the longitudinal length of structural member 12 for carrying level during transportation.

A one piece jack screw 24 operatively associated with the sleeve nut 18 provides the lifting capacity. The outer diameter of the center 26 of the jack screw 24 is sized to match the outer diameter of the structural member 12. At least one through hole 28 is placed through the center section 26 of the jack screw 24 for receipt of jack handle 40. Preferably two holes are placed therethrough allowing jack handle 40 access at 90 degree positions. At the top of the jack screw 24 is formed an alignment neck, not shown, for insertion into the cavity of the upper structural member.

The upper structural member 30 is constructed of heavy duty pipe correlating to the base structural member 12. The upper structural member 30 is formed into a uniform design allowing insertion of the first alignment neck of the jack screw 24 into either end. A handle 32 is centrally located along the longitudinal length of the upper structural member 30 providing a balanced carrying position for ease of transporting and installing.

A channel 34 is made available for disposition on the free end of the upper support member 30. The channel 34 is sized to accommodate the temporary horizontal beam 112 for raising or support of the entire floor 114. Channel 34 is constructed of metal having a base with two side walls 48 projecting upward therefrom. Each sidewall having a flat outer surface and a flat side surface. Alternatively, as shown, the sidewall can be sloped to ensure alignment of the horizontal beam 112 to the center of the channel 34. Attached to the bottom surface of the channel 34 is a shoulder 36 operatively associated with the upper support member 30, the shoulder 36 resting upon the sidewall of the upper support member 30. A second alignment neck, not shown, extends from the shoulder 36 of the channel 34 for insertion into the free end cavity of the upper structural member 30.

Figure 3:
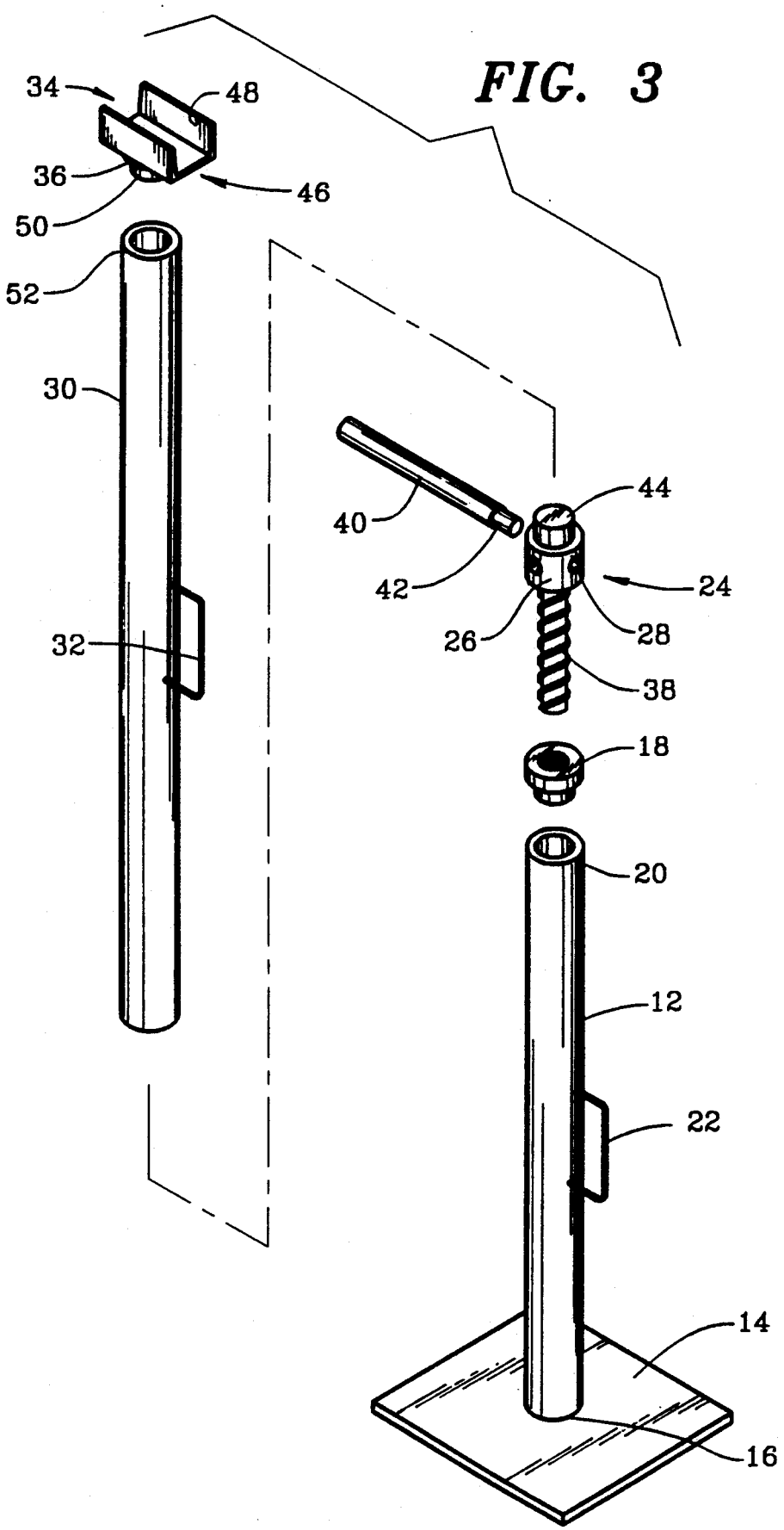
FIG. 3 is an exploded view illustrating the individual components of the instant invention.

FIG. 3 is an exploded view of the preferred embodiment illustrating the base structural member 12 which is constructed of tubular steel, preferably 3" outside diameter heavy gauge sidewall pipe. The planar base plate 14 welded to the support member 12 is a steel ⅜" plate having a foot print of 8" or greater. The base plate 14 welded 16 to the structural member 12 allowing vertical alignment in relation to the flooring. At the top of member 12 is a sleeve nut 18 welded along joint 20 to member 12. The sleeve nut 18 should provide at least two inches of threaded engagement and for optimum force transfer, generally sizing is placed at 2"×2 square threads per inch. As previously mentioned, due to the weight difference between support plate 14 and sleeve nut 18, handle 22 is located at a predetermined position along the longitudinal length of structural member 12 for carrying level during transportation.

The one piece jack screw 24 provides the lifting capacity. For instance, the use of a 1 ½" diameter thread portion 38 allows for raising up to 12 tons; a 2" diameter thread 38 allows for raising up to 20 tons, a 2 ½" diameter thread 38 allows for raising up to 24 tons, and so forth. The outer diameter of the center 26 of the jack screw 24 is sized to match the outer diameter of the structural member 12 or 3 inches which is the preferred embodiment. At least one through hole 28 of about 1" diameter is placed through the center section 26 of the jack screw 24 for receipt of a jack handle 40. Preferably two holes are placed therethrough allowing jack handle 40 access at 90 degree positions.

The jack handle 40 is an extension rod for leveraged rotation of the jack screw 24. By rotation of the jack screw 24 upward, the jack can provide a lifting support from 10 to 30 tons depending the jack screw diameter. The jack handle 40 having an overall length of 25" of 1 ⅛" diameter round stock constructed of hardened steel. For insertion into the jack screw hole 28, a three inch section is turned down to 63/64" providing force transfer across the jack screw hole 28. It should be obvious to one skill in the art that various modification to the jack handle is possible without defeating the object of this patent, including, the use of a jack handle that extends through the jack screw hole 28 allowing two operators to rotate the handle simultaneously to exert the rotational force to jack screw 24.

At the top of the jack screw 24 is formed a first 2 ¼" diameter alignment neck 44 extending therefrom for insertion into the cavity of the upper structural member 30. The upper structural member 30 is tubular steel preferably having a 3" outside diameter constructed of heavy duty pipe correlating to the base structural member 12. The upper structural member 30 is formed into a uniform design allowing insertion of the first alignment neck 44 of the jack screw 24 into either end. The first alignment neck 44 made of sufficient tolerance to cause the upper member 30 to stay in direct alignment with the jack screw 24 and thus the base structural member 2. The handle 32 providing a balanced carrying position for ease of transporting and installing. For use in the conventional home the overall longitudinal length of the upper support 30 member is approximately 48". As previously mentioned, the length of the upper support member can be sized for a particular ceiling height and variations are deemed a part of this invention. The 48" length is sized for the conventional 7 foot basement ceiling. The length of the upper support member 30 is slightly longer than the lower support member 12 allowing the operator to lift the lighter of the two supports for installation purposes and provide an optimum operating position. The base structural support 12 member, for use in the conventional home, has an overall longitudinal length of approximately 32" which includes the base support plate 14 and sleeve nut 18.

The channel 34 is made available for disposition on the free end of the upper support member 30. The channel 34 is constructed of metal having a base with two side walls 48 projecting upward therefrom. Each sidewall having a flat outer surface and a flat side surface. Alternatively, as shown, the sidewall can be sloped to ensure alignment of the beam to the center of the channel 34. Attached to the bottom surface of the channel 34 is 3" diameter shoulder 36 which is operatively associated with the upper support member 30. The shoulder 36 rests upon the sidewall of the upper support member 30. A second 2 ¼" diameter alignment neck 50 extends from the shoulder 36 of the channel 34 for insertion into the free end cavity of the upper structural member 30. The second alignment neck 50 made of sufficient tolerance to cause the channel 34 to stay in direct alignment with the upper structural member 30 and thus the base structural member 12. The length of each neck, 44 and 50, is at least ¾" for proper engagement and alignment purposes.

In operation, the improved house jack of the instant invention allows the operator to carry the support members to the installation site by use of handles 22 and 32. The base structural member 12 having the planar base plate 14 stood beneath a beam to be supported. The threaded jack screw 24 is stored in the opposite end of the base structural member 12, the first alignment neck 44 protruding therefrom. One end of the upper structural member 30 is then placed over the first alignment neck 44 to create a uniform upright post. The free end of upper structural member 30 is then made available for placement of channel 34, the second alignment neck 50 of the channel inserted into cavity 52 of the upper structural member 30. The jack handle 40 is inserted into one of the jack screw holes 28 wherein the screw is un-threaded from the base structural support 12 causing the upper structural support 30 to telescope upward. As the channel 34 approaches the beam to be supported, the handle 22 to the base member 12 can be used to align the device directly beneath the beam. The jack handle 40 is then used to raise the support beam to the desired height. By use of the jack handle 40 at a height near the operators waist, force can be exerted upon the handle 40 by use of the operator legs to provide force in place of the operators back muscles.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A heavy duty house jack in the form of a kit for the temporary support of building joists, said kit comprising:

a base support member formed from an elongated hollow pipe, said base member having a first end permanently coupled to a base plate and a second end having a threaded engagement means disposed therein, said first end and second end separated by a first predetermined length with a handle mounted along the length thereof;

an engagement jack screw having a lower portion operatively associated with said threaded engagement means of said base member and an upper portion forming an alignment neck;

means for rotating said engagement jack screw;

an upper support member releasably coupled to said alignment neck to said engagement jack screw, said upper support member constructed from an elongated hollow pipe having a symmetrical first end and second end separated by a second predetermined length with a handle mounted along the length thereof; and a means for aligning said upper support member to an overhead building joist or support beam, said means for aligning releasable coupled to the first end of said upper support member;

whereby said second end of said upper support member is placed upon said alignment neck of said engagement jack screw predisposed in said base support member wherein rotation of engagement jack screw causes said upper support member to telescope upward for the exertion of force and support of said overhead building joist.

2. The support structure kit according to claim 1 wherein said base support member is further defined as 3" outside diameter heavy gauge sidewall pipe having a length of at least 30 inches.

3. The support structure kit according to claim 1 wherein said base plate is further defined as a steel $\frac{3}{8}$ inch plate having an 8 inch foot print welded to said first end of said base support member.

4. The support structure kit according to claim 1 wherein said threaded engagement means is further defined as a threaded sleeve nut welded to the second end of said base support member.

5. The support structure kit according to claim 4 wherein said sleeve nut has at least 1 $\frac{1}{2}$" diameter and 2 square threads per inch over a two inch engagement area.

6. The support structure kit according to claim 1 wherein said engagement jack screw is further defined as a one piece harden steel rotatable jacking screw having at least one through hole for placement of an extension rod for leveraged rotation thereof, said engagement jack screw having threaded engagement area corresponding to said threaded engagement means coupled to said base support member.

7. The support structure kit according to claim 6 wherein said extension rod is defined as a 1 $\frac{1}{8}$" hardened steel rod having an overall length of at least 25 inches and a portion of the rod turned down to 63/64" for insertion into said through hole.

8. The support structure kit according to claim 1 wherein said upper support member is further defined as a 3" outside diameter heavy gauge sidewall pipe having a length of about 48 inches.

9. The support structure kit according to claim 1 wherein said means for aligning said upper support member to defined as a metal channel having a base with two side walls projecting upward therefrom, said channel including a support shoulder coupled to a lower surface of said channel for accepting force transfer from the end of the upper support member sidewall, said shoulder including a neck portion for rotatable insertion into the free end cavity of said upper support member sidewall.

10. The support structure kit according to claim 9 wherein said side walls of said metal channel are sloped to provide a means for centering a joist or support beam.

* * * * *